US006742415B2

(12) United States Patent
Scott

(10) Patent No.: US 6,742,415 B2
(45) Date of Patent: Jun. 1, 2004

(54) REMOTELY OPERABLE OPENING MECHANISM FOR POTENTIALLY BOOBY-TRAPPED LATCHED PANELS

(75) Inventor: Gordon D. Scott, Orleans (CA)

(73) Assignee: Her Majesty the Queen in right of Canada as represented by the Solicitor General acting through the Commissioner of the Royal Canadian Mounted Police, Ottawa (CA)

( * ) Notice: Subject to any disclaimer, the term of this patent is extended or adjusted under 35 U.S.C. 154(b) by 12 days.

(21) Appl. No.: 10/180,515

(22) Filed: Jun. 27, 2002

(65) Prior Publication Data

US 2003/0000346 A1 Jan. 2, 2003

Related U.S. Application Data

(60) Provisional application No. 60/301,809, filed on Jul. 2, 2001.

(51) Int. Cl.[7] ..... B25B 7/00

(52) U.S. Cl. ..... 81/15.9; 269/3; 269/6

(58) Field of Search ..... 81/15.9, 367, 129; 269/3, 6

(56) References Cited

U.S. PATENT DOCUMENTS

| | | | | | |
|---|---|---|---|---|---|
| 2,197,128 | A | * | 4/1940 | Harrison | 81/314 |
| 3,964,352 | A | | 6/1976 | Dukes | 81/426 |
| 4,277,864 | A | | 7/1981 | Orson, Sr. | 24/327 |
| 4,312,488 | A | | 1/1982 | Pierron | 248/74 R |
| 4,478,451 | A | | 10/1984 | Brucher et al. | 294/106 |
| 4,565,414 | A | | 1/1986 | French | 399/32 R |
| 4,631,855 | A | * | 12/1986 | Ader | 43/53.5 |
| 4,706,525 | A | | 11/1987 | Fenner | 81/15.9 |
| 4,826,457 | A | | 5/1989 | Varatta | 439/755 |
| 4,850,254 | A | * | 7/1989 | Burney | 81/367 |
| 5,050,466 | A | * | 9/1991 | Cameron | 81/419 |
| 5,123,307 | A | | 6/1992 | Dyer | 81/15.9 |
| 5,148,581 | A | | 9/1992 | Hartmann | 24/351 |
| 5,642,648 | A | | 7/1997 | Wendt et al. | 81/15.9 |
| 5,937,713 | A | | 8/1999 | Walters | 81/15.9 |
| 6,438,854 | B1 | * | 8/2002 | Kott, Jr. | 33/286 |

FOREIGN PATENT DOCUMENTS

| | | |
|---|---|---|
| CA | 1065364 | 10/1979 |
| CA | 1238068 | 6/1988 |
| CA | 2019092 | 6/1990 |
| CA | 2007666 | 11/1990 |
| CA | 2125309 | 6/1994 |
| DE | 198 55 579 A1 | 11/1999 |
| GB | 922661 | 4/1963 |

* cited by examiner

*Primary Examiner*—Lee D. Wilson
(74) *Attorney, Agent, or Firm*—Marks & Clerk

(57) ABSTRACT

A remotely operable opening mechanism for potentially booby-trapped latched panels has a clamp member for clampable engagement with a fixed structure on the panel. A displaceable actuator is mounted on the clamp member. The displaceable actuator has a protruding element engageable with a latch on the latched panel and a coupling element for connection to a line to permit remote activation of the actuator to release the latch member and thereby permit the latched panel to be opened from a safe distance.

32 Claims, 9 Drawing Sheets

REMOTELY OPERABLE OPENING MECHANISM FOR POTENTIALLY BOOBY-TRAPPED LATCHED PANELS

CROSS-REFERENCE TO RELATED APPLICATION

This application claims the benefit of U.S. Provisional Application No. 60/301,809 filed Jul. 2, 2001, incorporated by reference herein.

FIELD OF THE INVENTION

The present invention relates to tools used to remotely manipulate vehicle, enclosure or building access where there is a potentially dangerous or hazardous situation.

BACKGROUND OF THE INVENTION

When trying to open doors, cabinets, drawers or other panels in a potentially dangerous or hazardous environment, there is a requirement to quickly and remotely manipulate these items to safely pull them open from a safe distance. The same requirement arises when attempting to clear and declare safe a potentially booby-trapped vehicle or when removing a suspect package from an office or vehicle via length of rope.

Presently, a bomb technician, or other law enforcement officer, must improvise some device for this purpose. The devices are commonly improvised using already existing and readily available items such as vice-grips, rope, duct tape and hooks, which need to be configured and adapted according to each unique situation.

Many times these panels are also latched in some manner, requiring that the latch be manually released prior to opening the panel.

SUMMARY OF THE INVENTION

Disclosed is a remotely operable latched panel opening mechanism designed to both release a latch on a panel and open the panel after the latch has been released.

According to one aspect, the remotely operable latched panel opening mechanism for potentially booby-trapped latch panels comprises a clamp member for clampable engagement with a structure on said panel, and a displaceable actuator mounted on said clamp member. The displaceable actuator has a protruding element engageable with a latch on said latched panel and a coupling element for connection to a line to permit remote activation of said actuator to release said latch and thereby permit said latched panel to be opened by remotely pulling on said clamp member. The panel may be a door, a drawer, a car hood or any other such barrier means. The line may be a rope, cable chain or the likes, serving as a pulling means.

These clamps mainly consist of two arms, each having a jaw end and a handle end. The two members are pivotably joined by means to maintain the clamp in the closed position when released. Further, one of the members of these clamps has a passage for an adjustable blocking element, which abuts on the other member. The jaw ends of the clamp can have different teeth configurations to allow clamping engagement with the structure to be remotely manipulated.

The displaceable actuator allows a latch to be remotely released in a separate action from using the clamp to open the panel. The displaceable actuator includes pivoting and sliding adjusting mechanisms for adaptation to particular situations.

In another embodiment, there is provided a method of opening potentially booby-trapped latched panels using a remotely operable opening mechanism comprising a clamp member and a displaceable actuator mounted on said clamp member, said displaceable actuator having a protruding element and a coupling element, the method comprising the steps of clamping the clamp member with a structure on the panel, engaging the protruding element with a latch on the panel, and connecting the coupling element to a line to permit remote activation of said actuator to release said latch and thereby permit said latched panel to be opened by remotely pulling on said clamp member.

In another embodiment, there is provided a kit of remotely opening latched panels, comprising a clamp member for clampable engagement with a structure on said panel, and a displaceable actuator mounted on said clamp member, said displaceable actuator having a protruding element engageable with a latch on said latched panel and a coupling element for connection to a line to permit remote activation of said actuator to release said latch and thereby permit said latched panel to be opened by remotely pulling on said clamp member.

The mechanism allows law enforcement officers to release and open potentially booby-trapped panels.

Other aspects and advantages of embodiments of the invention will be readily apparent to those ordinarily skilled in the art upon a review of the following description.

BRIEF DESCRIPTION OF THE DRAWINGS

Embodiments of the invention will now be described in conjunction with the accompanying drawings, wherein.

This invention will now be described in detail with respect to certain specific representative embodiments thereof, the materials, apparatus and process steps being understood as examples that are intended to be illustrative only. In particular, the invention is not intended to be limited to the methods, materials, conditions, process parameters, apparatus and the like specifically recited herein.

DETAILED DESCRIPTION OF THE PREFERRED EMBODIMENTS

Figure 1:
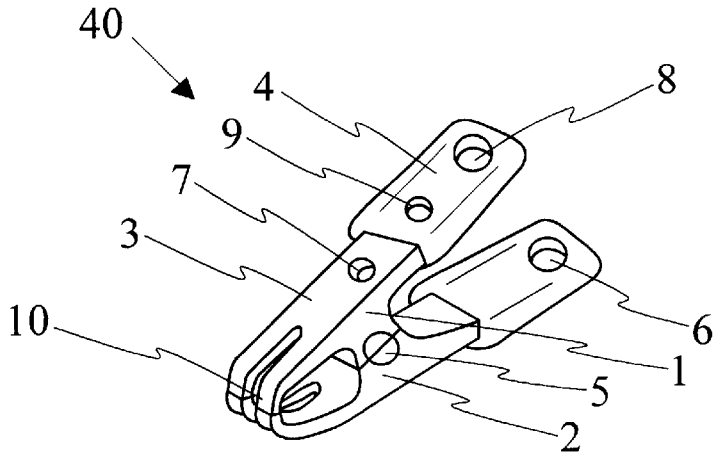
FIG. 1 is a perspective view of one embodiment of a clamp in accordance with the present invention.

A basic clamp member is shown in FIG. 1. This comprises two clamp arms 1, 2, each having a jaw end 3 and a handle end 4. The jaw end 3 can embrace different teeth configurations as described below. The jaw end 3 is used for clamping engagement with a structure on a panel, such as a door knob or handle. In an exemplary embodiment shown in FIG. 1, there are two teeth 10, which are curved and sharpened so that the clamp member can be placed over and behind the structure to be pulled via pulling means, such as a cable or a rope (not shown). The members are pivotably joined together by means 5 (typically a spring) to maintain the clamp in clamping engagement with the structure to be pulled when released.

Figure 2:
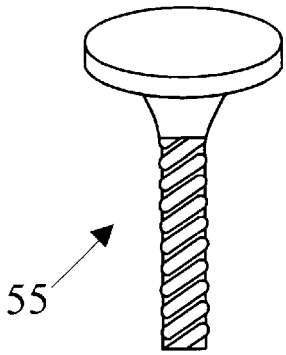
FIG. 2 illustrates a bolt that may be used as a blocking means to adjust the gap between the teeth of a clamp.

Since these clamps are sometimes pulled with excess force, blocking means (illustrated in FIG. 2) can be used to avoid opening of the clamp when pulled. As an example, the blocking means is shown in FIG. 2 to be a screw 55. The blocking means cooperates with a passage 9 in one arm of the clamp to abut on the opposite interior side of the other arm of the clamp. This blocking means is adjustable to variable depth depending on the desired gap between the jaw teeth 10.

Figure 3:
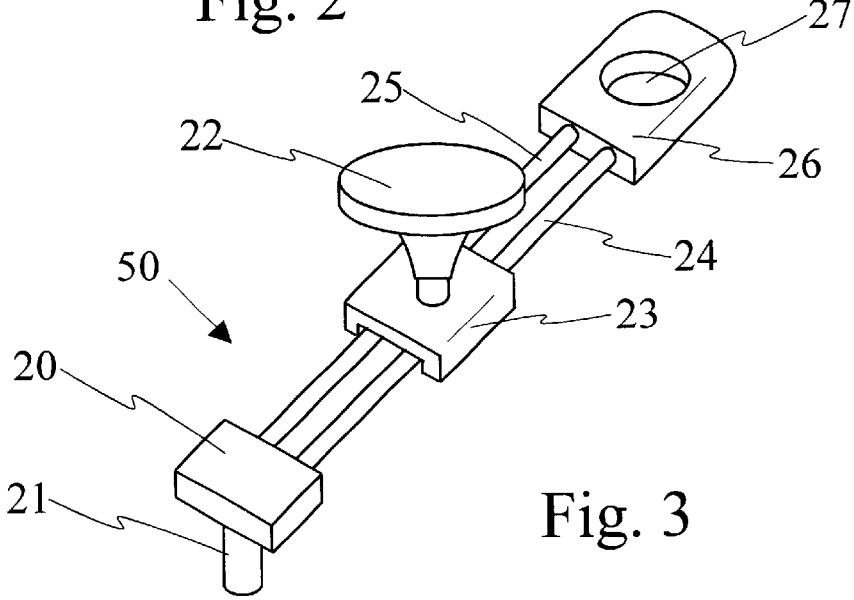
FIG. 3 illustrates a perspective view of a finger latch attachment.
Figure 4:
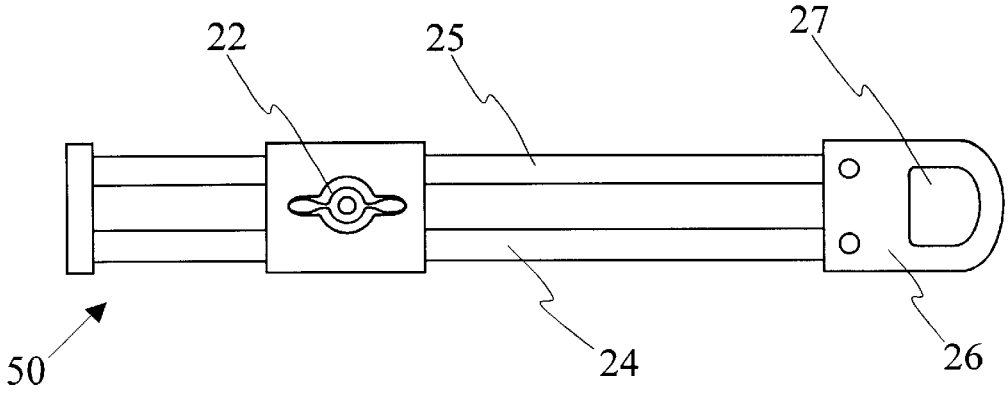
FIG. 4 illustrates a top view of the finger latch attachment of FIG. 3.
Figure 5:
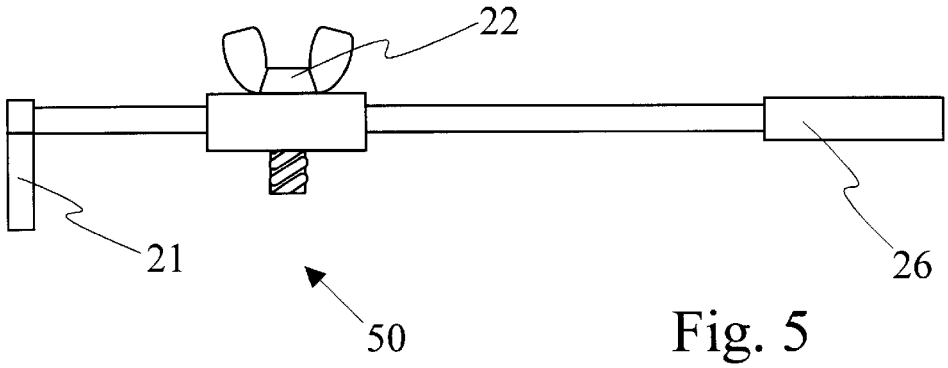
FIG. 5 illustrates a side view of the finger latch attachment of FIG. 3.

Preferably, the clamp has a hole 8 in the handle end 4 of at least one arm to allow attachment of a pulling means (not shown), preferably a rope or a cable. Alternatively, the pulling means may attach at two holes 8 in each handle end. There is provision of a second passage 7 to fasten accessories or tools with the blocking means to be used in cooperation with the clamps As mentioned above, quite often the panel to be opened has a latch which must first be released. In this case, the clamp is used with a displaceable actuator designed to release a latch on a panel to be opened. A first such tool is shown in FIGS. 3, 4 and 5. This finger latch mechanism 50 is used when a latch, usually designed to be pulled by a finger, has to be retracted prior to opening a panel, such as a door. This finger latch 50 comprises a latch operation end 20 having a boss 21 shaped to protrude behind the latch to pull on it. A pulling end 26 has a hole 27 used to attach pulling means (not shown), preferably a rope or a cable or any type of line to permit remote activation of actuation to release the latch. The latch operation end 20 and the pulling end 26 are joined together by two bars 24, 25. A sliding element 23 movably retains the bars 24, 25 over the clamp with a second blocking means 22.

Figure 6:
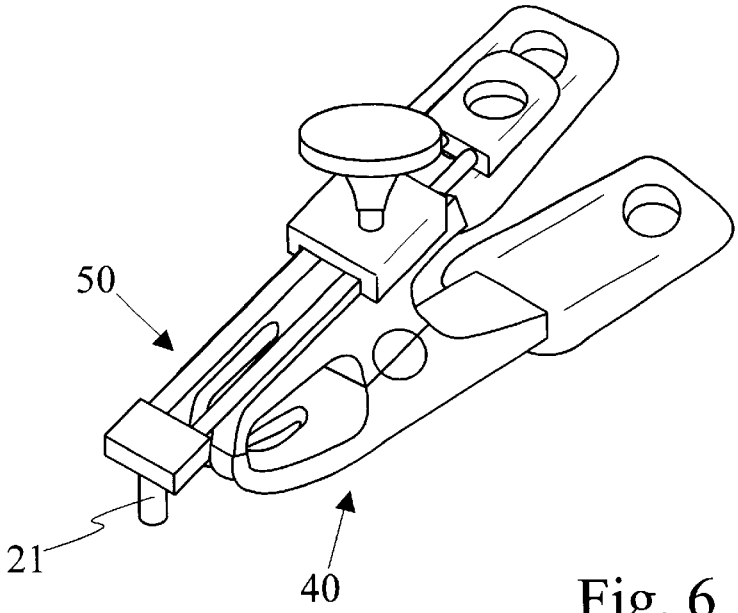
FIG. 6 illustrates a perspective view of the finger latch attachment of FIG. 3 mounted on the clamp of FIG. 1.

This mechanism is preferably bolted to the clamp via hole 7 after the clamp has been positioned on the structure to be pulled. FIG. 6 shows the finger latch 50 mounted on clamp 40. The entire mechanism can be mounted upside down if needed, in particular when the finger latch is hinged horizontally along the length of a door handle. The rope is attached to the mechanism such that the attachment slides along the length of the clamp when the rope is pulled.

In operation, the clamp is installed over a structure to be pulled, such as a handle, adjacent to the latch The finger latch attachment 50 is installed such that the boss 21 is behind the latch to be pulled. A line serving 27*a* as pulling means is attached to the hole 27 in the pulling end 26 of the mechanism. The latch is then retracted by operating the latch attachment 50 by remotely pulling the line 27*a* from a safe distance, and the door can then be opened by continuing to pull on the line.

Figure 7:
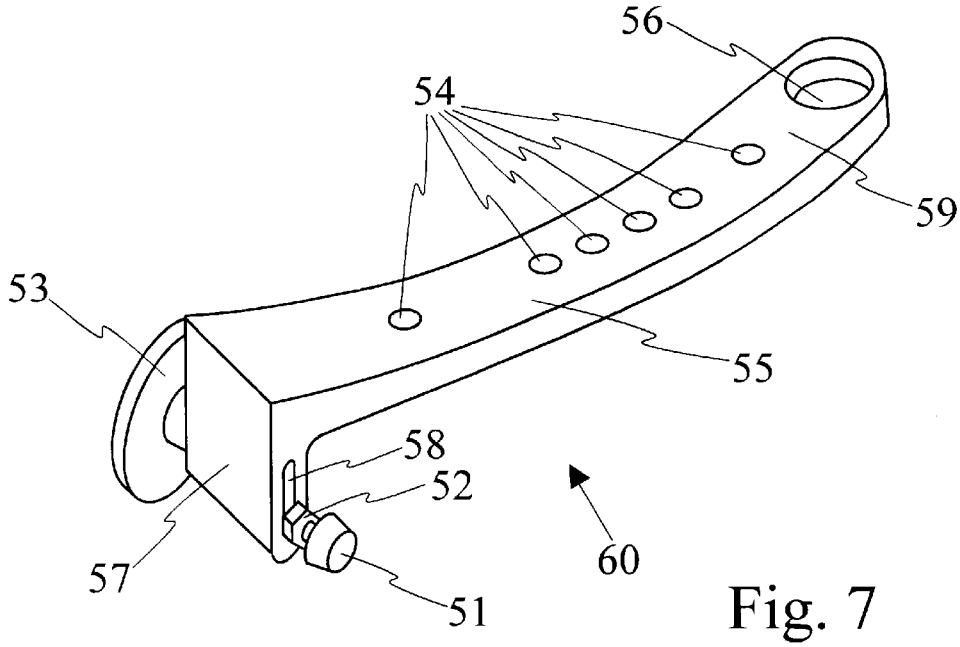
FIG. 7 illustrates a perspective view of a thumb latch attachment.
Figure 8:
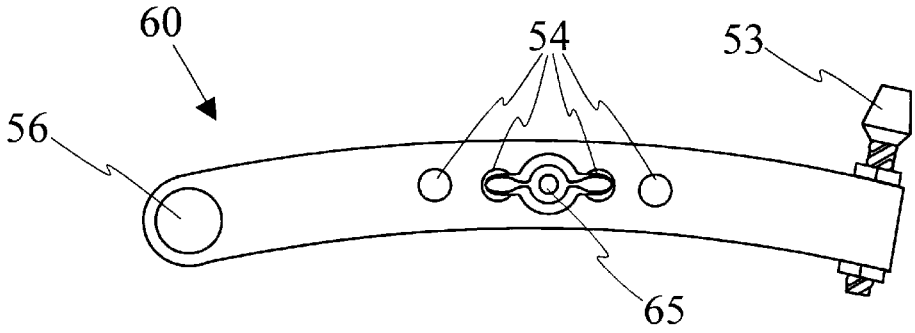
FIG. 8 illustrates a top view of the thumb latch attachment of FIG. 7.
Figure 9:
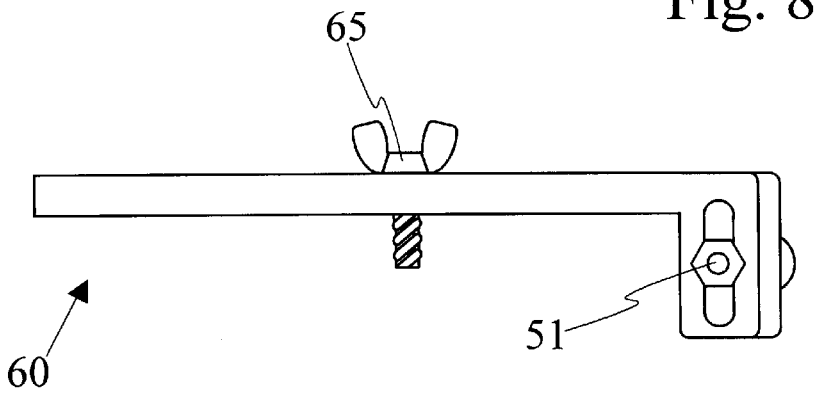
FIG. 9 illustrates a side view of the thumb latch attachment of FIG. 7.

A second such displaceable actuator 60 is shown in FIGS. 7, 8 and 9. This thumb latch mechanism is used when a latch, usually designed to be pushed by a thumb, has to be pressed prior to opening a door. This thumb latch 60 comprises a latch operation end 57, a pivoting portion 55 and a pulling end 59. The pivoting portion 55 and the pulling end 59 form an arcuate elongated member. The latch operation end 57 is at the opposite end of the pulling end 59 and is substantially perpendicular to the pivoting portion 55. The pivoting portion comprises a series of holes 54 spaced to adapt to a wide variety of thumb latch spacing dimensions. The pulling end 59 has a hole 56 used to attach pulling means (not shown). The distance between the selected hole 54 according to the situation and the pulling end hole 56 provides the necessary lever action to push on the latch. FIGS. 8 and 9 illustrate the bolt 65 threaded in a selected hole. The latch operation end 57 has an adjustably mounted plunger 51 to press on the latch. An elongated hole 58 provides a first axis adjustment of a plunging means 51. The adjustments on the plungers on the plunger 51 help to accurately position the plunger 51 for maximum force. A threaded element joining the plunger 51 to a knob 53, in cooperation with a bolt 52, provides a second axis adjustment perpendicular to the first axis adjustment. When the plunger 51 is axially aligned with the center of the latch, the operator can block the plunger 51 in position by turning the knob 53. The latch can now be pressed by pulling line attached to the pulling end hole 56, and the door can be opened by pulling on the clamp.

Figure 10:
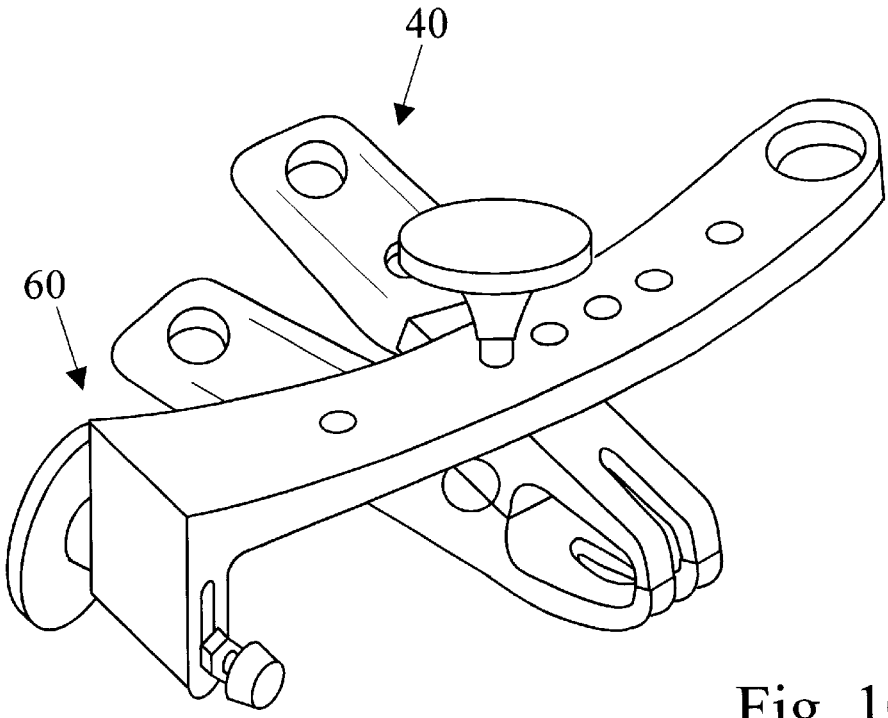
FIG. 10 illustrates a perspective view of the thumb latch attachment of FIG. 7 fastened to the clamp of FIG. 1.

This mechanism is preferably bolted to the clamp via hole 7 after the clamp has been positioned on the structure to be pulled. FIG. 10 shows the thumb latch 60 mounted on the clamp member 40. The whole mechanism can be oriented to accommodate various situations, as with the finger latch mechanism.

With the use of the pulling means operating the clamp member and the displaceable actuator, a latch is released in an independent action from the pulling action of the clamp to open the panel. In an alternate embodiment, another pulling means is attached to the hole 8 of one handle end 4 of the clamp, such that one pulling means operates displaceable actuator and another pulling means operates the clamp.

Figure 11:
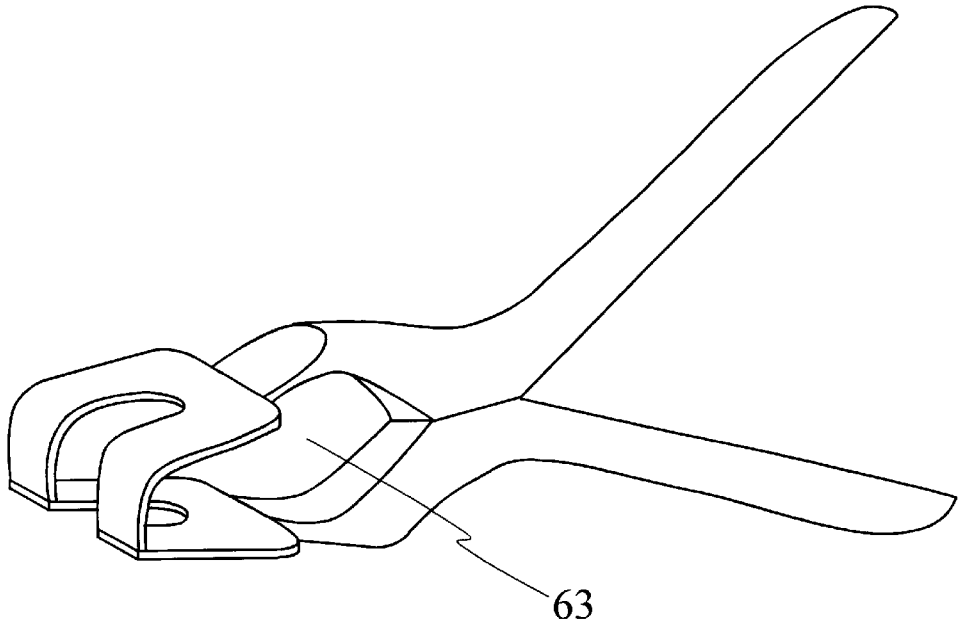
FIG. 11 is a perspective view of an example of a clamp of larger dimension.

Various configurations of clamp teeth may be used on the jaw ends 3 of the clamp to be adapted to all kinds of structures, including hinges, knobs or handles. As will be obvious to one skilled in the art, the clamps can be also of various dimensions, adapted to the ease of installation. For most clamp dimensions, the external shape of the clamps are similar, but when the clamp become larger, the external shape changes, in order to obtain a larger gap 63 between the teeth, as seen in FIG. 11.

The foregoing is by way of example only and is not intended to be limiting in any way. FIGS. 12 to 27 illustrate possible shapes of clamp teeth that may be used.

Figure 12:
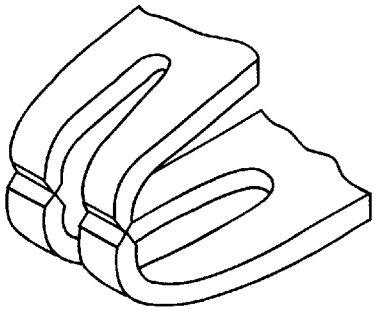
FIG. 12 is a perspective view illustrating the teeth shape of a basic small nose clamp.
Figure 13:
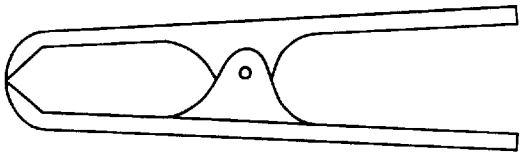
FIG. 13 is a side view of a small long nose clamp.
Figure 14:
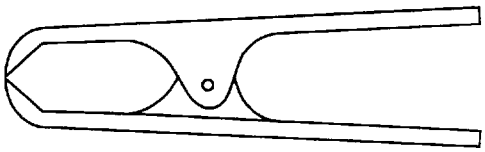
FIG. 14 is a side view of a small short nose clamp.

FIG. 12 illustrates the basic shape of a small nose clamp. The clamp teeth size may vary. FIG. 13 illustrates a small long nose clamp, and FIG. 14 illustrates a small short nose clamp. The clamp of FIG. 14 is a shorter version of the clamp illustrated in FIG. 13, to allow it to fit in places where the longer clamp of FIG. 13 will not fit. Both these clamps are spring loaded clamps with a split in the opening end to enable the clamp to be fastened around hood latches that have a pull handle mechanism. The ends are curved and sharpened so that the clamp can be placed over and behind the structure to be operated via a rope, and the pull direction of the pulling means is along the length of the clamp.

Figure 15:
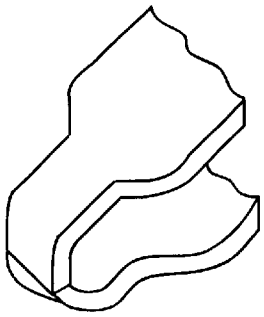
FIG. 15 is a perspective view illustrating the teeth shape of a small needle nose clamp.
Figure 16:
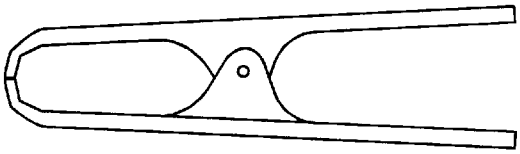
FIG. 16 is a side view of a small needle nose clamp.

FIGS. 15 and 16 illustrate a small needle nose clamp which is a spring loaded clamp with a narrow end to enable the clamp to be inserted and fastened around narrow items such as head rest supports, wires or other items where there is insufficient room for a larger clamp. The ends are curved and sharpened so that the clamp can be placed over and around the structure to be operated via a rope and the pull direction of the pulling means is along the length of the clamp.

Figure 17:
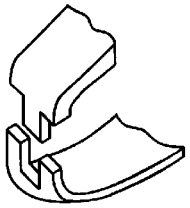
FIG. 17 is a perspective view illustrating the teeth shape of a inner locking clamp.
Figure 18:
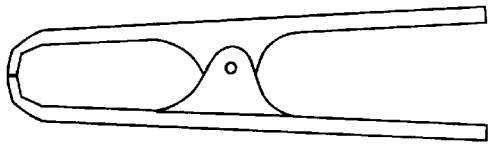
FIG. 18 is a side view of a small inner locking clamp.

FIG. 17 illustrates the basic shape of an inner locking clamp. The clamp teeth size may vary. FIG. 18 illustrates a small inner locking clamp, which is a spring loaded clamp with a full width end to enable the clamp to be inserted and fastened around a variety of objects. It is a general purpose clamp that can be used to attach to vehicle door handles, vehicle rain gutters and numerous other surfaces and protrusions. The ends are curved and sharpened so that the clamp can be placed over and around the structure to be operated via a rope and the pull direction of the pulling means is along the length of the clamp.

Figure 19:
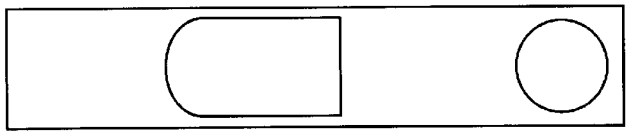
FIG. 19 is a top view of a large inner locking clamp.
Figure 20:
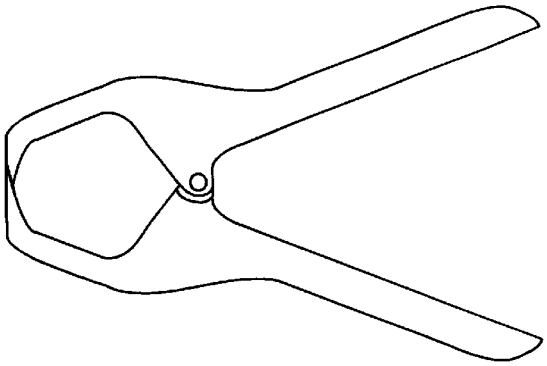
FIG. 20 is a side view of the large inner locking clamp of FIG. 19.

FIGS. 19 and 20 illustrate a large inner locking clamp, which is a larger version of the clamp of FIG. 18 with a full width jaw to enable the clamp to be inserted and fastened around a variety of objects. It is designed to attach to large railings, water pipes, road signs, wheel covers, car frames, commercial business door handles and may even be attached to 2" pipe bombs. The ends are curved and sharpened so that the clamp can be placed over and around the structure to be operated via a rope and the pull direction of the pulling means is along the length of the clamp. This clamp is most often used with pulleys for change of direction during hook and line procedures.

Figure 21:
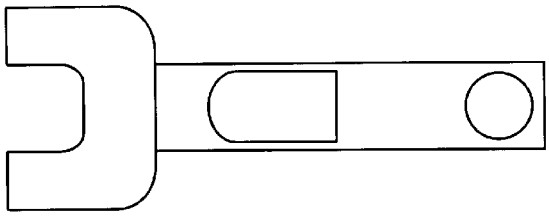
FIG. 21 is a top view of a large double inner locking clamp.
Figure 22:
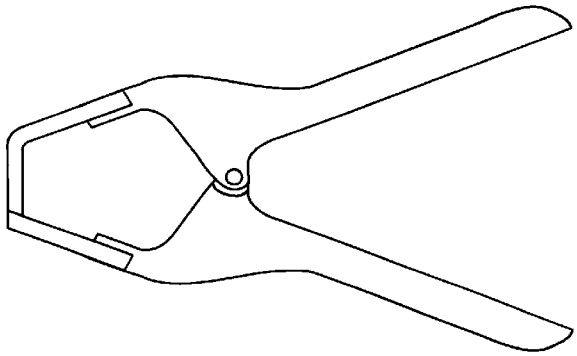
FIG. 22 is a side view of the large double inner locking clamp of FIG. 21.

FIGS. 21 and 22 illustrate a large double inner locking clamp, which is a wider version of the clamp of FIGS. 19 and 20 with a triple width jaw to enable the clamp to be inserted and fastened around a variety of objects. It is designed to attach to large railings, water pipes, road signs, wheel covers, car frames, commercial business door handles and may even be attached to 2" pipe bombs. With the increased width, the clamp will stay exactly where it is placed on a pipe and will not slide or twist when attached. The ends are curved and sharpened so that the clamp can be placed over and around the structure to be operated via a rope. This clamp is most often used with pulleys for change of direction during hook and line procedures.

Figure 23:
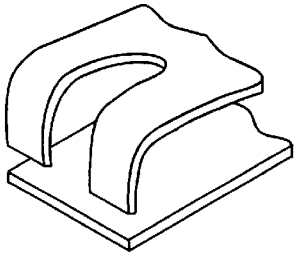
FIG. 23 is a perspective view illustrating the teeth shape of a small flat clamp.
Figure 24:
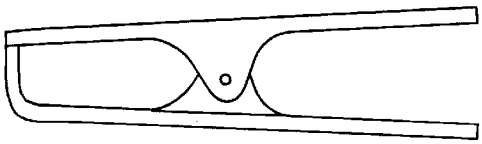
FIG. 24 is a side view of a small flat clamp.

FIGS. 23 and 24 illustrate a small flat clamp, which is a spring loaded clamp with one side sharpened and curved and the other side flat. It is designed to attach to vehicle hood releases which are hinged on one side. The flat side is placed behind the hood release and the clamp is pushed all the way across the release until the curved end is completely around the hinge, and the pull direction of the pulling means is at 90 degrees to the length of the clamp. The ends are curved and sharpened so that the clamp can be placed over and around the item to be pulled via a rope.

Figure 25:
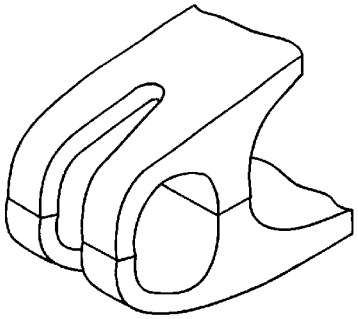
FIG. 25 is a perspective view illustrating the teeth shape of a basic small clamp for use with vehicle door handles.
Figure 26:
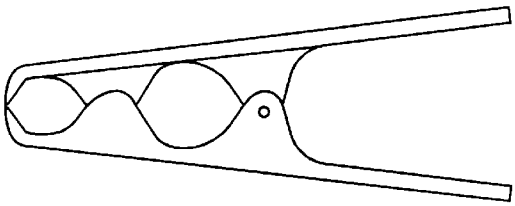
FIG. 26 is a side view of a small round clamp.

The clamp of FIG. 25 illustrates the basic shape of another small clamp. FIG. 26 illustrates a small round clamp of this type which is a spring loaded clamp with a sharpened and split end. While this clamp can be used for many other applications, it was specifically designed to hold the latch attachments in place on vehicle door handles. The clamp is attached to the vehicle door handle at right angles to the handle. The handle is placed in the first opening of the clamp since the clamp must be held firmly in position on the handle. The appropriate latch attachment either the thumb latch or finger latch mechanism is then bolted to the clamp via the threaded insert and a rope is attached to the latch attachment rather than to the clamp. As the rope is pulled in the appropriate manner, the attachment either depresses the thumb latch or pulls the finger latch behind the handle.

Figure 27:
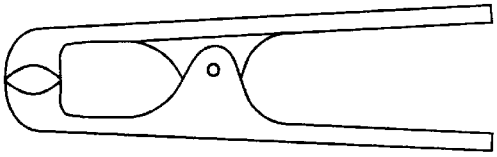
FIG. 27 is a side view of a small v-nose clamp.

The clamp of FIG. 27 is a small v-nose clamp which has a similar use to the clamp of FIG. 26. While this clamp can be used for many other applications, it was specifically designed to hold the latch attachments in place on vehicle door handles. The handle is placed in the first opening of the clamp since the clamp must be held firmly in position on the handle. The first opening in the clamp is smaller than that of FIG. 26. The clamp is used with the thumb latch attachment on narrower vehicle door handles, where the clamp of FIG. 26 is too large.

Preferably, the thumb latch attachment is used in conjunction with the clamps of FIGS. 26 and 27 when manipulating the car door handle, since the series of mounting holes accommodate the wide range of thumb latch spacing dimensions possible for vehicle door handles. This will permit the plunger 51 to be centered over the thumb latch so that when the rope is pulled, the plunger 51 will pivot on the appropriate mounting hole and depress the thumb latch mechanism. The choice of either the clamp of FIG. 26 or 27 is determined by the thickness of the vehicle door handle. The whole mechanism can be mounted upside down depending on whether the thumb latch is on the right or left side of the handle.

The clamp of FIG. 27 is the primary clamp for use on finger latches, since the smaller opening prevents the clamp jaws from protruding too far behind the door handle, thus preventing the finger latch from retracting sufficiently enough to open the door. The clamp of FIG. 27 prevents the finger latch mechanism from retracting all the way on narrower door handles because the jaws almost meet when attached to the door handle at right angles. The clamp of FIG. 27 is also a spring loaded clamp with a sharpened and split end.

In operation, the appropriate latch attachment is bolted to the clamp with teeth of FIG. 27 via the threaded insert, and a rope is attached to the latch attachment rather than the clamp. As the rope is pulled, the appropriate attachment either depresses the thumb latch or pulls the finger latch behind the handle. Once the latch is fully depressed, continued pull on the rope will cause the door to swing open. The first opening on this clamp is small so that the jaws do not protrude too far behind the handle and block the retraction of the finger latch, therefore, there is a limited portion of the clamp jaws attached to the door handle.

Figure 28:
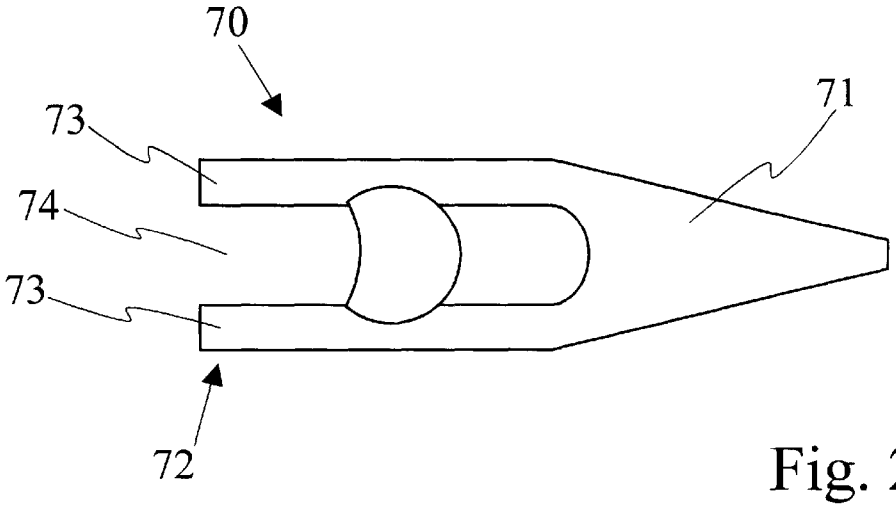
FIG. 28 is a top view of a hood latch.
Figure 29:
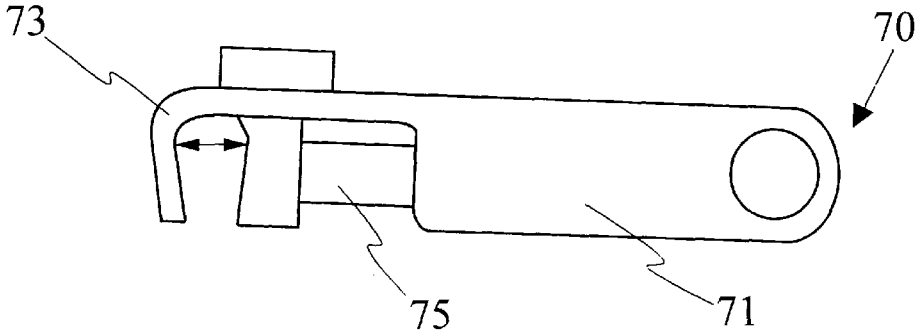
FIG. 29 is a side view of the hood latch of FIG. 28.

The clamping member may also be a specialized clamp member designed for specific situations. FIGS. 28 and 29 illustrate a hood release 70 which is designed to attach to structures which are hinged, flat or have a lip where only one side of the clamp can be inserted. It can also be attached to engine compartment hood release mechanisms, as well as to the hood itself, to pull the hood open after the locking mechanism has been manipulated. The clamp member comprises a body 71 having a split jaw 72 defining two teeth 73 and a split 74. The slide spring 75 is retracted to open the jaw 72 so that the end can be fitted behind the structure to be pulled. When attached, it will hold itself in place via the spring 75. The jaws are split so that the clamp can be attached around protruding portions to whatever it is attached.

Figure 30:
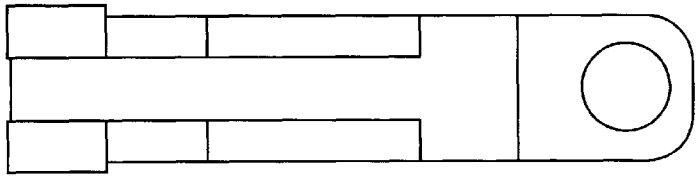
FIG. 30 is a top view of a spring loaded car door pull.
Figure 31:
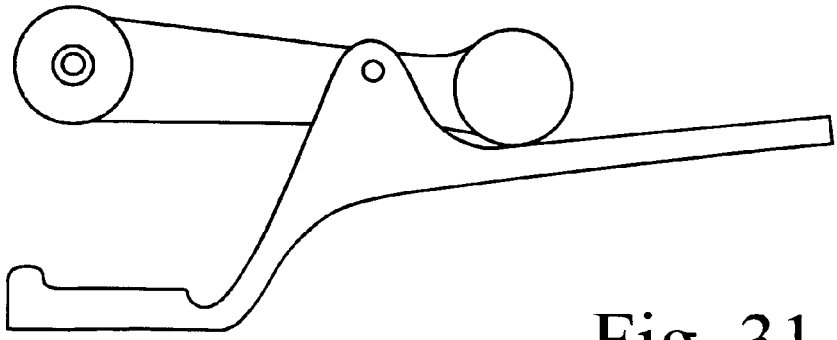
FIG. 31 is a side view of spring loaded car door pull of FIG. 30.

FIGS. 30 and 31 illustrate a spring loaded car door pull, which is designed as a universal, hinged car door handle attachment which when attached to the door handle is held in place by the spring tension. The clamp has been designed to take advantage of the raised lip on the rear edge of all door handles of this type. This raised portion of the handle helps keep the fingers from sliding off the handle during opening. It also acts as a drip lip and runs the entire length of the handle on the reverse side. The narrow portion of the clamp is placed behind the handle and over top of the raised portion on the rear edge of the handle. There is sufficient tension on the clamp to keep the clamp attached to the handle during the pull. The spring tension is sufficient in almost all cases to prevent the clamp from sliding over the raised edge of the handle and disengaging. The larger rounded portion of the clamp provides a larger surface friction on the front of the handle surface and helps keep the clamp from sliding or twisting during normal pulls. The pull is kept substantially perpendicular to the door handle, since it is only the substantial spring tension which holds the clamp in place.

Figure 32:
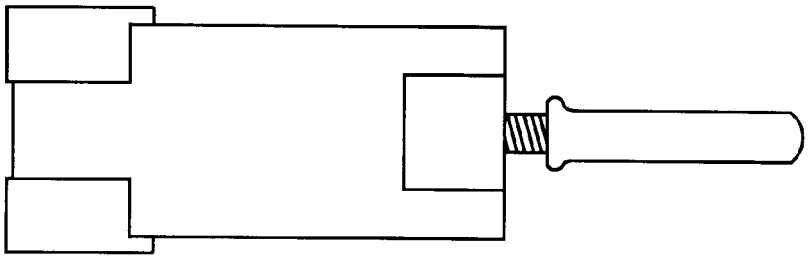
FIG. 32 is a top view of a locking car door pull.
Figure 33:
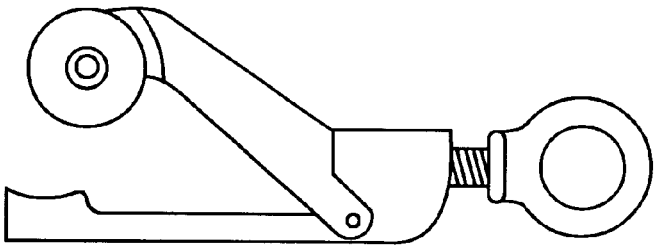
FIG. 33 is a side view of the locking car door pull of FIG. 32.

FIGS. 32 and 33 illustrate a locking car door pull, which is designed as a universal, hinged car door handle attachment which can be manually locked on the handle by turning the threaded eye bolt on the end. There are instances where there is a misalignment of the car door on its frame which makes it difficult to open the door by pulling even after the door mechanism has functioned correctly. This misalignment can cause the clamp of FIGS. 30 and 31 to break away from the door handle when the pull is particularly difficult, since it is only held in place by the spring tension. In these situations the clamp of FIGS. 32 and 33 can be forcefully attached so that it will not slide off during the pull. The flat portion of the clamp is placed behind the door handle taking advantage of the raised portion of the handle. This raised edge is present on the reverse side edge of all door handles of this type. It prevents the fingers from slipping off the handle when pulling it open. The wide round portion of the opposite side of the clamp provides a wider surface area on the front of the handle to increase the holding ability and prevent the clamp from twisting during the pull. The direction of pull is not as critical when this clamp is forcefully attached.

To be ready for any situation, all the parts are part of a kit, which can include a set of clamps of different shapes, dimensions and jaw teeth, along with the finger latch and thumb latch mechanisms and their accessories. The kit is brought to the site by the intervention team, so that they can select the proper clamp(s)/accessory(ries) in view of the situation.

Numerous modifications may be made without departing from the spirit and scope of the invention as defined in the appended claims.

What is claimed is:

1. A remotely operable apparatus for opening a panel retained in a closed position by a latch member, said panel having a handle for normally permitting manual opening of said panel, and said panel being potentially booby-trapped so as to be liable to cause harm to a person manually grasping said handle, said apparatus comprising:

a clamp member for clampable engagement with a fixed structure on said panel; and a displaceable actuator mounted on said clamp member so as to be displaceable relative to said clamping member when said clamping member is in clamping engagement, said displaceable actuator having a protruding element engageable with said latch member and a coupling element connected to a line deployable to a remote location at a safe distance from said panel to permit remote operation of said actuator from said remote location so as to release said latch member and thereby permit said latched panel to be opened from said remote location.

2. The apparatus of claim 1, wherein the clamp member comprises two clamp elements, each having a jaw end and a handle end, the two clamp elements being pivotally joined with a bias element to maintain the clamp member in the dosed position when released.

3. The apparatus of claim 1, wherein the displaceable actuator is a finger latch mechanism and wherein the protruding element is a boss on one end of the finger latch mechanism shaped to pull on the latch member.

4. The apparatus of claim 3, wherein the finger latch mechanism is slideably mounted along the length of the clamp member to facilitate pulling action of the boss on the latch.

5. The apparatus of claim 1, wherein the displaceable actuator is a thumb latch mechanism and wherein the protruding element is a plunger shaped to push on the latch.

6. The apparatus of claim 5, wherein the thumb latch mechanism is mounted to the clamp member such that activation of the thumb latch mechanism causes a lever action of the thumb latch mechanism relative to the clamp member to facilitate the pushing action of the plunger on the latch when a pulling force is exerted on the line.

7. The apparatus of claim 1, wherein the clamp member has a jaw end for clampable engagement with the structure on the panel.

8. The apparatus of claim 7, wherein the jaw end is a small nose clamp adapted for a hood latch having a pull handle mechanism.

9. The apparatus of claim 7, wherein the jaw end is a small needle nose clamp adapted for clampable engagement with relatively narrow structures.

10. The apparatus of claim 7, wherein the jaw end is a small flat clamp adapted for clampable engagement with a hood release which is hinged on one side.

11. The apparatus of claim 7, wherein the clamp member is a hood release with a jaw end having two teeth defining a split.

12. The apparatus of claim 1, wherein the clamp member is a spring loaded and adapted to engage a car door handle.

13. The apparatus of claim 1, wherein the clamp member is a locking car door pull.

14. A method of opening a panel retained in a closed position by a latch member, said panel having a handle for normally permitting manual release of said latch member to open said panel, and said panel being potentially booby-trapped so as to be liable to cause harm to a person manually rasping said handle, said method comprising the steps of:

attaching a clamp member to a fixed structure on the panel;

engaging a protruding element forming part of a displaceable actuator mounted on said clamp member with said latch member on the panel;

deploying a line connected to said displaceable actuator to a remote location at a safe distance from said panel;

pulling on said line from said remote location to operate said actuator by displacing said actuator relative to said clamp member and thereby release said latch member to permit said latched panel to be opened from said remote location.

15. The method of claim 14, wherein the clamp member comprises two clamp elements, each having a jaw end and a handle end, the two clamp elements being pivotably joined with a bias element to maintain the clamp in the closed position when released.

16. The method of claim 14, wherein the displaceable actuator is a finger latch mechanism and wherein the protruding element is a boss on one end of the finger latch mechanism shaped to pull on the latch.

17. The method of claim 16, wherein the finger latch mechanism is slideably mounted along the length of the clamp member to facilitate pulling action of the boss on the latch.

18. The method of claim 14, wherein the displaceable actuator is a thumb latch mechanism and wherein the protruding element is a plunger shaped to push on the latch.

19. The method of claim 18, wherein the thumb latch mechanism is mounted on the clamp member such that activation of the thumb latch mechanism causes a lever action of the thumb latch mechanism relative tot he clamp member to facilitate the pushing action of the plunger on the latch.

20. The method of claim 14, wherein the clamp member has a jaw end for clampable engagement with the structure on the panel.

21. A kit for opening a panel retained in a closed position by a latch member, said panel having a handle for normally permitting manual opening of said panel, and said panel being potentially booby-trapped so as to be liable to cause harm to a person grasping said handle, said kit comprising:

a clamp member for clampable engagement with a fixed structure on said panel; and a displaceable actuator mountable on said clamp member so as to be displaceable relative to said clamping member when said clamping member is in clamping engagement, said displaceable actuator having a protruding element engageable with said latch member on said latched panel and a coupling element; and a said line attachable to said coupling element and deployable to a remote location at a safe distance from said panel to permit remote operation of said actuator from said remote location so as to release said latch member.

22. The kit of claim 21, wherein the clamp member comprises two clamp elements, each having a jaw end and a handle end, the two clamp elements being pivotably joined with a bias element to maintain the clamp member in the closed position when released.

23. The kit of claim 21, wherein the displaceable actuator is a finger latch mechanism and wherein the protruding element is a boss on one end of the finger latch mechanism shaped to pull on the latch.

24. The kit of claim 23, wherein the finger latch mechanism is slideably mountable along the length of the clamp member to facilitate pulling action of the boss on the latch.

25. The kit of claim 21, wherein the displaceable actuator is a thumb latch mechanism and wherein the protruding element is a plunger shaped to push on the latch.

26. The kit of claim 25, wherein the thumb latch mechanism is mountable on the clamp member such that activation of the thumb latch mechanism causes a lever action of the thumb latch mechanism relative to the clamp member to facilitate the pushing action of the plunge on the latch.

27. The kit of claim 21, wherein the clamp member has a jaw end to for clampable engagement with the structure oil the panel.

28. The kit of claim 27, wherein the jaw end is a small nose clamp adapted for a hood latch having a pull handle mechanism.

29. The kit of claim 27, wherein the jaw end is a small needle nose clamp adapted for clampable engagement with relatively narrow structures.

30. The kit of claim 27, wherein the jaw end is a small flat clamp adapted for clampable engagement with a hood release which is hinged on one side.

31. The kit of claim 27, wherein the clamp member is a hood release with a jaw end leaving two teeth defining a split.

32. The kit of claim 21, wherein the clamp member is a spring loaded and adapted to engage a car door handle.

* * * * *